US009247337B2

(12) United States Patent
Foudhaili et al.

(10) Patent No.: US 9,247,337 B2
(45) Date of Patent: Jan. 26, 2016

(54) HEADPHONE AND HEADSET

(71) Applicant: Sennheiser electronic GmbH & Co. KG, Wedemark (DE)

(72) Inventors: Hatem Foudhaili, Hannover (DE); Axel Grell, Burgdorf (DE); Martin Streitenberger, Hannover (DE); Daniel Voss, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 65 days.

(21) Appl. No.: 14/338,781

(22) Filed: Jul. 23, 2014

(65) Prior Publication Data

US 2015/0030173 A1 Jan. 29, 2015

Related U.S. Application Data

(63) Continuation-in-part of application No. PCT/EP2013/065523, filed on Jul. 23, 2013.

(51) Int. Cl.
*G10K 11/16* (2006.01)
*H04R 1/10* (2006.01)

(52) U.S. Cl.
CPC ..... *H04R 1/1083* (2013.01); *H04R 1/1008* (2013.01); *H04R 2410/05* (2013.01)

(58) Field of Classification Search
CPC ..... G10K 2210/1801; G10K 2210/108; G10K 11/1788; H04R 1/1083
See application file for complete search history.

(56) References Cited

U.S. PATENT DOCUMENTS

| | | | | |
|---|---|---|---|---|
| 8,379,872 | B2 * | 2/2013 | Parkins | H04R 1/1058 381/317 |
| 9,143,850 | B2 * | 9/2015 | Andersen | H04R 1/10 |
| 2005/0013456 | A1 | 1/2005 | Chalupper et al. | |
| 2005/0257995 | A1 * | 11/2005 | Harris, Jr. | H04R 1/1083 181/129 |
| 2009/0103745 | A1 * | 4/2009 | Grell | H04R 1/1083 381/71.6 |
| 2011/0044464 | A1 | 2/2011 | Sapiejewski et al. | |
| 2012/0244801 | A1 * | 9/2012 | Lau | H04B 5/0006 455/41.1 |
| 2014/0185819 | A1 * | 7/2014 | Gleissner | H04R 1/1083 381/71.6 |
| 2014/0270225 | A1 * | 9/2014 | Gether | G10K 11/1788 381/71.6 |
| 2015/0003623 | A1 * | 1/2015 | Rasmussen | G10K 11/002 381/71.6 |

OTHER PUBLICATIONS

Extended European Search for Application No. 14177946.2 dated Dec. 3, 2014.

* cited by examiner

*Primary Examiner* — Simon Sing
(74) *Attorney, Agent, or Firm* — Frommer Lawrence & Haug LLP

(57) ABSTRACT

A headphone or earphone is provided which includes a housing with an open end and at least one defined dominant acoustic opening, an acoustically sealing earpad arranged at the open end of the housing, and at least one microphone arranged adjacent to common ear or in the vicinity of the dominant acoustical opening for detecting noise. The dominant acoustic opening is arranged within a radius of 2 cm around a midpoint of the at least one microphone. The headphone or earphone also includes an active-noise-compensation unit for performing an active noise compensation based on the output of the microphone and for generating a compensation signal. The headphone or earphone also includes an electro-acoustical transducer inside the housing for reproducing the compensation signal.

6 Claims, 11 Drawing Sheets

HEADPHONE AND HEADSET

The present is a continuation in part of International Application No. PCT/EP2013/065523, the disclosure of which is incorporated herein by reference in its entirety.

FIELD OF THE INVENTION

The present invention relates to a headphone and a headset.

It is noted that citation or identification of any document in this application is not an admission that such document is available as prior art to the present invention.

Headphones and earphones typically comprise a housing with an earpad which is placed onto the ear or around the ear of the user. The housing and the earpad can be acoustically substantially sealed or not sealed, i.e. acoustically open. Acoustically sealed headphones and earphones are advantageous as they have certain passive noise dampening capabilities. However, these earphones and headphones are sometimes uncomfortable to use, due to encapsulation effects like heat and moisture generation as well as acoustical occlusion (resulting in a changed own voice perception) and structure borne noise amplification (e.g. cable noise). On the other hand, acoustically not sealed or opened earphones or headphones do not have a passive noise dampening capability but are more comfortable to wear thanks to heat and moisture evacuation as well as avoidance of acoustical occlusion and structure borne noise amplification. Moreover, opened or semi-opened headphones are known for better audio quality thanks to the spatial hearing experience. Furthermore, venting of headphones is often used for acoustical tuning reasons (e.g. for bass amplification). Similarly, this venting impairs the passive noise dampening of the headphone.

U.S. Pat. No. 5,815,583 shows a headset having an open back as well as noise reduction capabilities.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph), such that applicant(s) reserve the right to disclaim, and hereby disclose a disclaimer of, any previously described product, method of making the product, or process of using the product.

SUMMARY OF THE INVENTION

It is therefore an object of the invention to provide a headphone and a headset which are acoustically not sealed and have at the same time a good noise isolation capability due to an improved active noise cancellation.

This object is solved by a circumaural or supraaural headphone comprising a housing with an open end and at least one defined dominant acoustic opening, an acoustically sealing earpad arranged at the open end of the housing, and at least one microphone arranged adjacent to common ear or in the vicinity of the dominant acoustical opening for detecting noise, wherein the dominant acoustic opening is arranged within a radius of 2 cm around a midpoint of the at least one microphone. The headphone also comprises an active-noise-compensation unit for performing an active noise compensation based on the output of the microphone and for generating a compensation signal. The headphone or earphone also comprises an electro-acoustical transducer inside the housing for reproducing the compensation signal. The at least one microphone is arranged or positioned such that a sound transmission time from the at least one microphone to an entrance of an ear channel of a user wearing the headphone is greater than a sound transmission time from the electro-acoustic transducer to the entrance of the ear channel. With such an arrangement of the microphone in the headphone, it is possible to use the additional time for the active noise compensation.

According to an aspect of the invention the headphone or earphone also comprises a sound-delaying unit arranged between the dominant acoustical opening and the open and of the housing for delaying a sound entering the dominant acoustical opening.

According to a further aspect, the microphone of the invention the microphone is a feed-forward microphone and the active-noise-compensation unit is based on a feed-forward algorithm.

According to a further aspect of the invention, the dominant acoustic opening has an area which is not larger than 7 $cm^2$.

According to a further aspect of the invention, the dominant acoustic opening is defined as that opening which when closed has a significant change of the insertion loss by at least 5 dB in the ⅓ octave bands from 200 Hz to 8 kHz.

According to the invention, the (feed-forward) microphone is arranged in the proximity of the dominant acoustical opening in the housing of the headphone, earphone or headset. The dominant acoustical opening is defined as an opening, which when closed has an insertion loss by at least 5 dB in the at least ⅓ octave bands from 200 Hz to 8 kHz. If the (feed-forward) microphone is arranged in the proximity of the dominant acoustical opening, the active noise cancelling or active noise reduction will be enhanced greatly.

Therefore, a headphone is provided which comprises a housing with an open end towards the ear of a user and at least one defined acoustic opening. The headphone or earphone furthermore comprises an acoustically sealing earpad at the open end of the housing, a microphone adjacent or in the vicinity of the acoustical opening for detecting noise, an electro-acoustical transducer inside the housing for reproducing an electrical signal into an audio signal. The headphone or earphone furthermore comprises an active-noise-compensation unit for performing an active noise compensation based on the output of the microphone. The active noise cancellation unit is furthermore adapted to output a generated compensation signal to the electro-acoustic transducer, which in turn is reproducing this compensation signal. Between the at least one acoustical opening and the first end of the housing, a sound-delaying unit may be provided for delaying the sound which is entering the acoustical opening.

The headphone can be embodied as a circum-aural or supra-aural headphone.

The headphone according to the invention comprises a feed-forward active noise cancellation capability. In a feedback active noise cancellation headphone, the microphone is arranged close to the position where the compensation is to be performed, for example the entrance of the ear channel and therefore inside the housing of the headphone. This is advantageous as noise or the audio signal can be picked up exactly at the position where it is to be compensated but on the other hand, the noise will have already reached the position where it is supposed to be compensated and therefore, there is no time left to compensate the received noise. It should be noted that the generation and transmittance of the compensation signal will also required some time. Therefore, a good compensation can only be achieved at low frequencies (with slowly changing noise signals).

However, in a feed-forward active noise cancellation system, the microphone is positioned such that primarily, the noise from outside is detected. This is advantageous as compared to a feedback active noise compensation as the noise signals which are to be compensated are already detected outside or at the outer regions of the headphone and thus the active noise cancelling units can have more time to generate a compensation signal. This can typically be performed during the time that the noise requires to travel to the entrance of the ear channel. The use of the feed-forward active noise cancellation, however, will depend on the position of the source of the noise as the noise will take different acoustic pathways and will require more or less time to travel. This variance increases with increasing frequency and a good compensation does not appear to be possible for frequencies above 1 kHz without using the invention. According to an aspect of the invention, the variance in the audio signal travelling time is to be reduced. Thus, according to an aspect of the invention, the sound transmission time from the microphone to the entrance of the ear channel is greater than the sound transmission time from the electro-acoustic transducer to the entrance of the ear channel.

According to an aspect of the invention, the dominant acoustic opening comprises a first end and a second end. The first end or entrance of the dominant acoustic opening is towards the outside and the second end is towards the inside of the housing 10. Between the entrance of the dominant acoustic opening and the position inside the housing where an entrance of an ear channel of a user wearing the housing is positioned, sound-delaying units can be provided to further delay the sound as entering the entrance of the dominant acoustic opening.

According to a further aspect of the invention, the housing comprises a ventilation opening. The ventilation opening is advantageous as it reduces any variations in the pressure inside the housing. However, the provision of a ventilation opening will lead to a reduced passive dampening of the housing.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
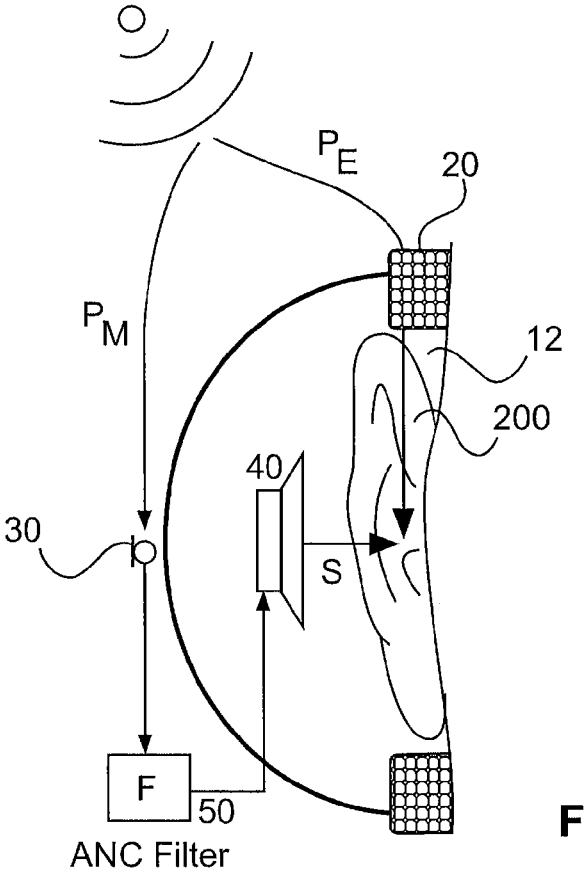
FIGS. 1A, 1C and 1D each show a schematic representation of a headphone.
Figure 1B:
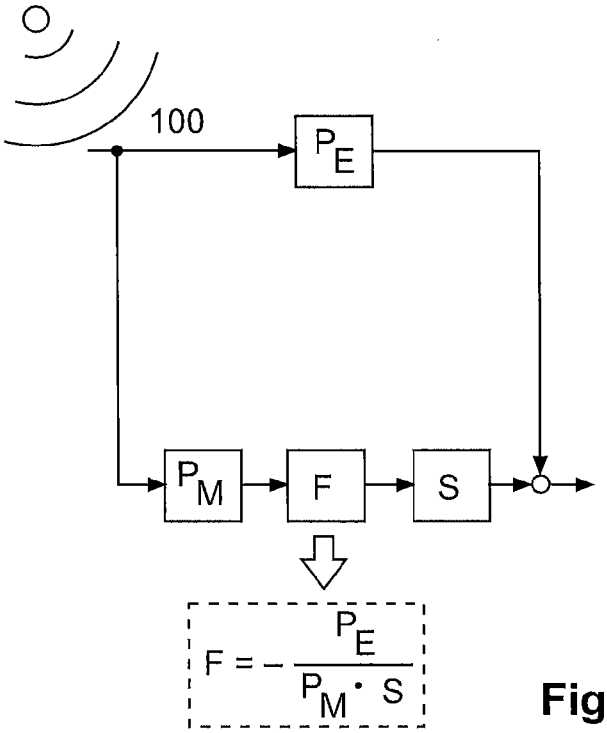
FIG. 1B shows an acoustic circuit diagram of the headphone according to FIGS. 1A, 1C, and 1D.
Figure 1C:
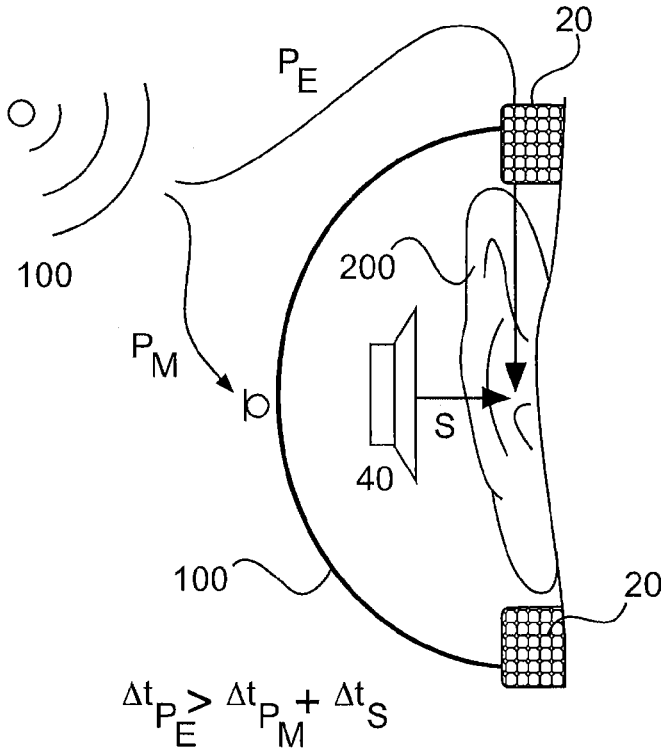
Figure 1D:
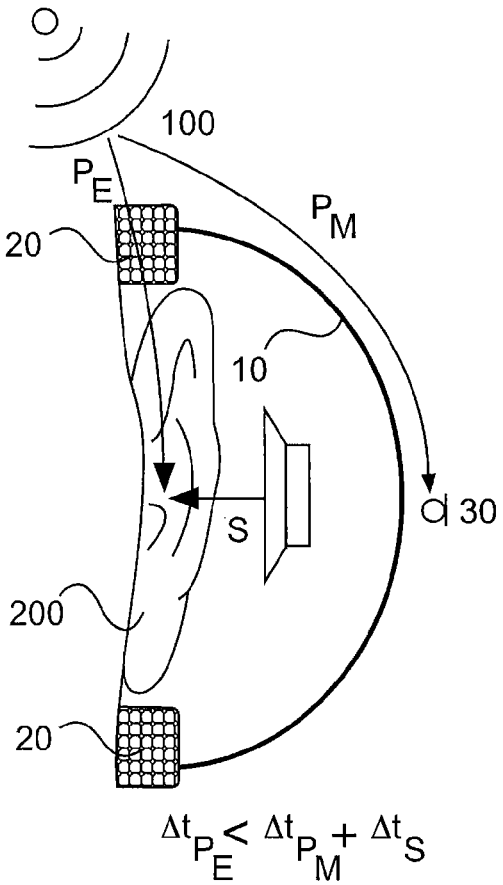

FIGS. 1A, 1C, and 1D each show a schematic representation of a headphone according to the prior art. FIG. 1B shows an acoustic circuit diagram of the headphone according to FIGS. 1A, 1C, and 1D. An audio source 100 transmits an audio signal or noise. The headset comprises a housing 10 with an open end 12, an earpad 20 arranged at the open end 12, an outer microphone 30, an electro-acoustic transducer 40 and an active-noise-compensation unit 50. The microphone 30 is used to detect the noise from the audio source 100 and forwards its output signal to the active-noise-compensation unit 50, which performs an active noise compensation based on the output signal of the microphone 30 and forwards an output compensation signal to the electro-acoustic transducer 40 which is used to reproduce the compensation signal.

In FIG. 1A, a headphone with a feed-forward active noise cancellation is depicted. The feed-forward algorithm is based on the fact that the outer microphone 30 detects any noise from the outside and that there is no significant feedback towards the electro-acoustic transducer 40 for outputting the compensation signal from the active noise cancellation unit ANC 50. The first path $P_M$ is the path from the sound source 100 to the feed-forward microphone 30. The second path $P_E$ is the path from the audio source 100 through the headphone directly to the ear 200. The headphone may comprise an earpad 20 at its open end 12.

It should be noted that the noise from the audio source 100 can reach the ear 200 via different acoustical paths. In FIG. 1A a transmission path through an acoustically not sealed earpad is depicted. In addition, the ear 200 can also receive the output signal of the electro-acoustic transducer 40.

In FIG. 1B, the acoustical circuit diagram is depicted, wherein the filter F corresponds to the active-noise-compensation unit 50 and the block S corresponds to the signal path of the output signal of the electro-acoustic transducer to the ear 200. When the filter F is a digital filter, the path S also includes the transmission characteristics of the digital signal processing hardware.

Accordingly, the required transmission function of the filter for the active-noise-compensation unit is $F=-P_E/(P_M \bullet S)$. It should be noted that the performance and the quality of the feed-forward active noise compensation depends on the causality and the invariance of the coefficient $P_E/(P_M \bullet S)$. Causality, since only causal filters can be realized. Invariance, since maximum performance can be reached in each case using the one optimal invariant Filter. The causality issue is e.g. described in US 2009/0046867, where a solution is proposed to minimize the latency of the digital signal processing in S so that causality holds. One aspect of the arrangement according to the present invention proposes an acoustical solution to maximize the latency of the coefficient $P_E/P_M$ so that causality holds.

The variance issue has different causes, like production differences, inter-individual differences and external sound field differences. Adaptive ANC systems can be a solution to adapt to occurring variances, while for non-adaptive ANC systems variances have to be minimized to guarantee performance. Production differences are treated by appropriate calibration during the production process. Inter-individual differences mostly occur when the seat of a headphone or earphone in, on or around the ear leads to a varying leakage depending on the user. Both the transmission path of the transducer to the ear (Path S) and the quantity of noise penetrating to the ear (Path $P_E$) are varying depending on the seat condition. This fact is described e.g. in US 2012/0148061, where a solution is proposed for decreasing the variance arising from inter-individual seat differences.

The third cause of variance, the external sound field differences, is relevant for circumaural and supra-aural headphones (no significant effect on earphones). It means that the coefficient PE/PM depends on the relative position of the sound source. In the case of in-ear headphones or hearing aid devices the coefficient PE/PM is not suffering from variance, due to the small design size of in-ear headphones, where acoustical transmission paths, openings and transducers are collocated in a confined space. Thus, variances occur only in the high frequency range (>5 kHz) at which in any case no ANC effect can practically be achieved. One further aspect of the arrangement according to this invention proposes a solution to minimize this kind of variance for circumaural and supraaural headphones. It should be noted that circumaural or supraaural headphones are advantageous as they allow an improved wearing comfort in relation to earphones worn in the ear. Earphones worn in the ear of the user may increase a sweating in the ears and may lead to skin irritations. Therefore, according to the invention, circumaural or supraaural headphones are used enabling a good wearing comfort.

In the FIGS. 1C and 1D, a headphone according to the prior art is shown. The headphone has an earpad 20 which is not acoustically sealed, a second path $P_E$ from the audio source 100 to the human ear 200 may lead through the earpad 20. In the FIGS. 1C and 1D, situations are shown where the position of the audio source 100 is different. Different positions of the audio source 100 can lead to different time delays in the different paths from the audio source 100 to the human ear 200.

The first condition for a good ANC performance is the causality of the coefficient $P_E/(P_M \bullet S)$. This condition is fulfilled if the time delay data $\Delta_{PE}$ of the path $P_E$ corresponds to or is greater than the sum of the delays $\Delta T_{PM}+\Delta T_S$ of the paths $P_M$ and S. In FIG. 1C, a situation is shown where the time delay of the path $P_E$ is greater than the sum of the time delay of the path $P_M$ and the path S. However, in the situation as shown in FIG. 1D, the time delay of the second path $P_E$ is smaller than the sum of the time delay of the first path $P_M$ and the path S. Accordingly, the performance of the headphone shown in the FIGS. 1A, 1C, and 1D is not optimal, since causality is not guaranteed for all situations. The second condition for a good ANC performance is the invariance of the coefficient $P_E/(P_M \bullet S)$. As shown in FIGS. 1C and 1D, the different transmission paths $P_E$ of sound from the audio source 100 to the ear via the earpads 20 and the different transmission paths $P_M$ of sound from the audio source 100 to the feed-forward microphone 30 lead to a variance of the coefficient $P_E/(P_M \bullet S)$. This leads to the situation where a specific ANC filter is required for each of the different relative positions of the audio source 100 relative to the ears 200 of the user. Accordingly, in the situation shown in the FIGS. 1A, 1C, and 1D, the performance of the headphones is not optimal.

Figure 2A:
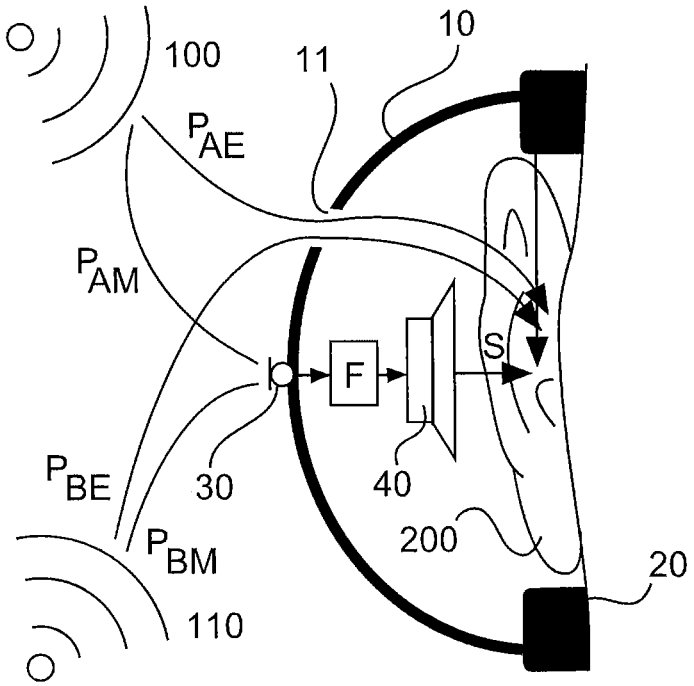
FIG. 2A shows a schematic representation of a headphone.

FIG. 2A shows a schematic representation of a headphone. The headphone has an earpad 20 which is acoustically sealed, but comprises a venting 11 at its ear cup 10. The sound transmission form a first audio source A 100 and a second audio source B 110 to the human ear lead through this opening 11. The (second) path $P_{AE}$ is the transmission from a first audio source A 100 to the human ear 200. The (second) path $P_{BE}$ is the transmission from a second audio source B to the human ear 200. The (first) path $P_{AM}$ is the transmission from a first audio source A 100 to the feed-forward microphone 30. The (first) path $P_{BM}$ is the transmission from a second audio source B to the feed-forward microphone 30.

Figure 2B:
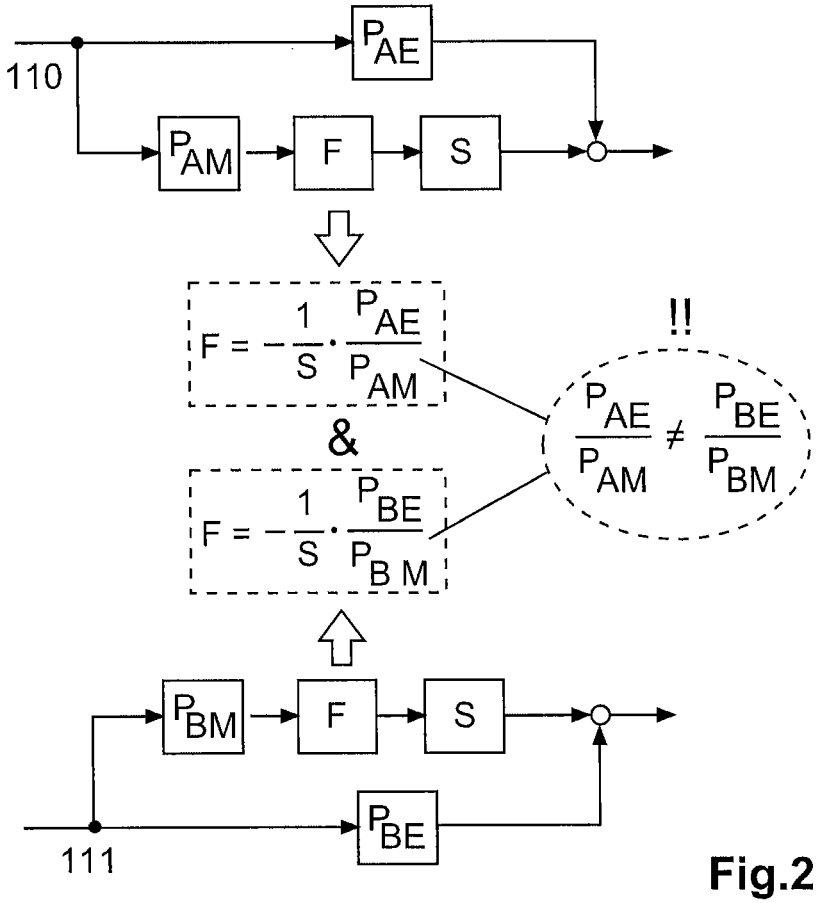
FIG. 2B shows an acoustic circuit diagram of the headphone according to FIG. 2A.

In FIG. 2B, the acoustical circuit diagram corresponding to FIG. 2A is depicted, wherein the filter F corresponds to the active-noise-compensation unit 50 and the block S corresponds to the signal path of the output signal of the electro-acoustic transducer to the ear 200. Accordingly, the required transmission function of the filter for the active-noise-compensation unit depends on the acoustic source position. For compensation of sound emitted by acoustic source A, the filter required is $F=-P_{AE}/(P_{AM} \bullet S)$. For compensation of sound emitted by acoustic source B, the filter required is $F=-P_{BE}/(P_{BM} \bullet S)$. Accordingly, in the situation shown in the FIG. 2A, the performance of the headphone is not optimal, since invariance does not hold.

Figure 3A:
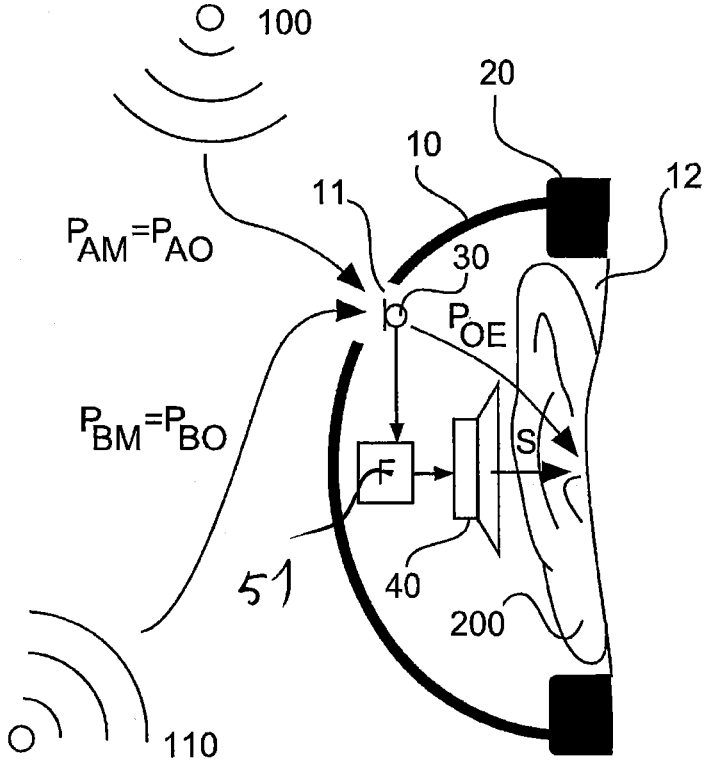
FIG. 3A shows a schematic representation of a headphone according to a first embodiment.

FIG. 3A shows a schematic representation of a headphone according to a first embodiment of the invention. The headphone according to the first embodiment comprises a housing 10 with an open end 12, an earpad 20 arranged or attached around the open end 12, a collector or acoustical opening 11 in the housing, a microphone 30 arranged in or adjacent to or near the collector opening 11 in the housing 10, an electro-acoustic transducer 40. The microphone 30 is used to detect noise from an audio source 100 and forwards its output signal to the active noise compensating unit 51 which performs an active noise compensation ANC based on the output signal of the microphone and forwards an output compensation signal to the electro-acoustic transducer 40 which is used to reproduce the compensation signal. The sound entering via the collector or acoustical opening 11 can enter the human ear 200 and in particular an ear channel of the user.

Preferably, the headphone is embodied as a circumaural or supraaural headphone which enables an improved wearing comfort in comparison to in-ear phones worn in the ear of the user.

Figure 3B:
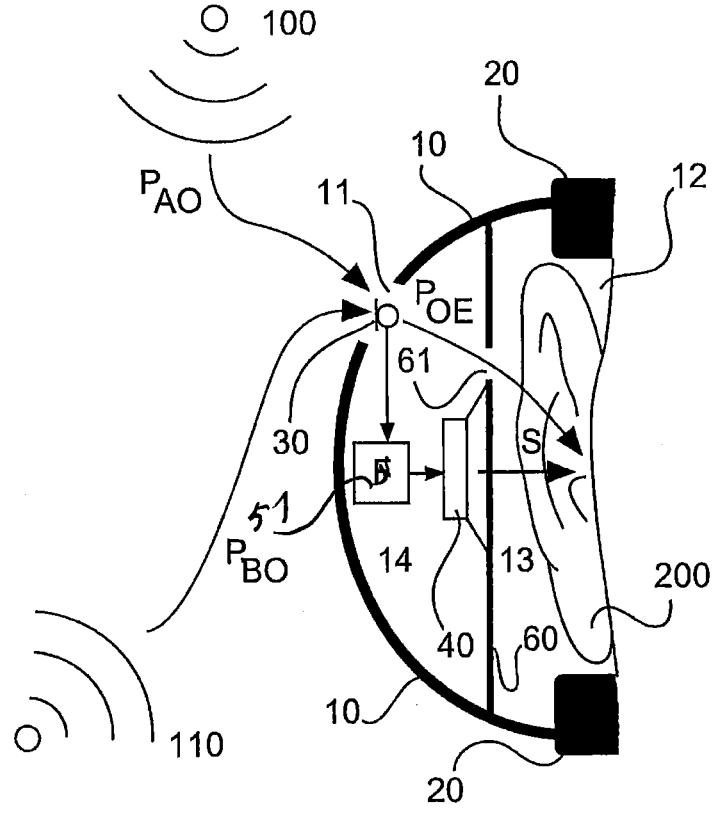
FIG. 3B shows a schematic representation of a headphone according to a second embodiment.

FIG. 3B shows a schematic representation of a headphone according to a second embodiment of the invention. The headphone according to the second embodiment comprises a housing 10 with an open end 12, an earpad 20 arranged or attached around the open end 12, a collector opening 11 in the housing 10, a microphone 30 arranged in or adjacent to or near the collector or acoustical opening 11 in the housing 10, an electro-acoustic transducer 40 and a baffle 60 which is arranged inside the housing 10 between the collector opening 11 and the earpad 20. The baffle 60 can be implemented as a wall 60*a* which comprises at least one opening 61 through which the sound entering via the collector opening 11 can enter the human ear 200. The baffle 60 can also be implemented in form of a bypass.

In the housing 10, a front volume 13 in front of the electro-acoustic transducer 40 and a rear volume 14 behind the electro-acoustic transducer 40 can be provided. The front volume 13 is present between the electro-acoustic transducer 40 and the open end 12 of the housing where the earpads 20 are arranged. The rear volume 14 is arranged behind the electro-acoustic transducer 40 and is enclosed by parts of the housing 10. The baffle or the bypass 60 is arranged between the front volume 13 and the rear volume 14. Via the openings 61 in the baffle unit 60, sound can enter via the collector opening 11 in the housing 10 and reach the ear 200.

Figure 3C:
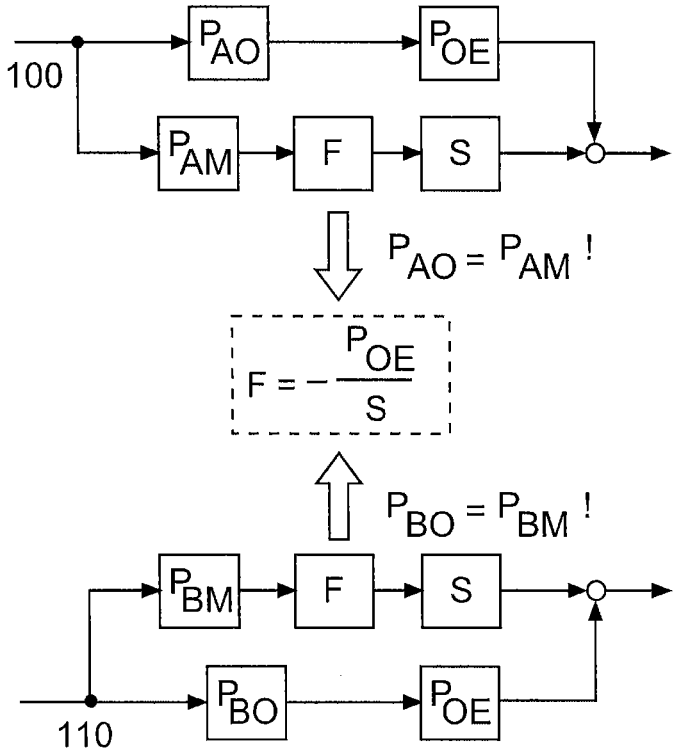
FIG. 3C shows an acoustic circuit diagram of the headphone according to FIG. 3A.

The sound paths $P_{AE}+P_{BE}$ from the audio sources 100, 110 to the ear each comprise two sub-paths, namely the path $P_{AO}$, $P_{BO}$ from the sound source 100, 110 to the collector opening 11 and the invariant path $P_{OE}$ from the collector opening 11 to the ear 200. According to the invention, the feed-forward microphone 30 is placed in, near or adjacent to the collector opening 11. Thus, the path $P_{AM}$, $P_{BM}$ from the sound source 100, 110 to the feed-forward microphone 30 is the same as the path $P_{AO}$, $P_{BO}$ from the sound source 100 to the opening 11. Thus, as shown in FIG. 3C, the required transformation function of the ANC filter 51 is reduced to:

$$F=-P_{OE}/S.$$

This means that sound coming from an arbitrary direction does have a unique invariant quotient of transmission $P_E/P_M$ which is $P_{OE}$, the sound transmission from the collector opening 11 or the microphone 30 to the ear 200 of the user. Accordingly, the condition of the invariance of the ANC filter 51 can be fulfilled irrespective of the position of the sound source relative to the ear.

In acoustically not sealed headphones ambient sound propagates through the openings of the headphone to the ear, which impairs their passive dampening. With the acoustical configuration of the headphone, or headset according to the invention, the penetrating noise can be actively damped at a much higher level than in prior art headphones. According to the first aspect of the invention, the openings 11 of the headphone can be reduced to one dominant collector opening, where the external sound is collected and enabled to propagate inside the ear. The sound penetrating through the collector opening 11 will then propagate to the ear with one invariant transfer function regardless of its original source. When a microphone 30 is placed near the one dominant collector opening and used for a feed-forward noise cancellation system, one invariant transfer function for the ANC filter 51 is present that cancels out optimally any sound penetrating. Thus a one-channel feed-forward active noise cancellation system using the microphone 30 placed near the collector opening 11 will offer a high active damping performance. In fact, the penetrating sound through the collector opening 11 can be cancelled out actively at a very high degree, restoring the passive dampening that the headphone would have, if it the collector opening 11 is closed. Good noise isolation is achieved thanks to improved active noise compensation while the advantages of an open or vented headset or headphone can be maintained.

Figure 3D:
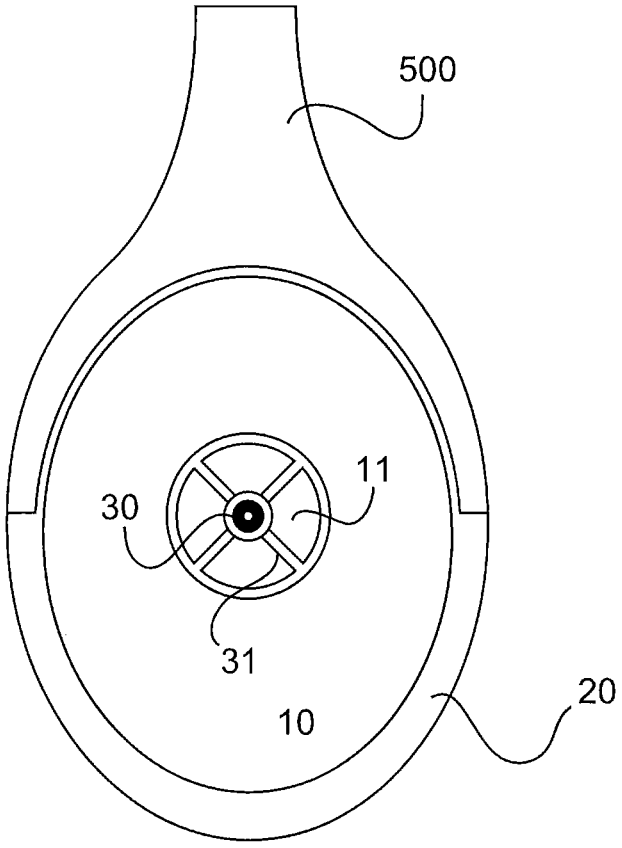
FIG. 3D shows a schematic representation of a headphone according to a third embodiment.

FIG. 3D shows a schematic representation of a headphone according to a third embodiment. The headphone comprises a headband 500 and at least one housing 10 attached to the headband. The cross-section of the collector opening 11 can be so large that the headphone or earphone acts as a nearly open headphone. But it should be noted that the principle of the invention (collecting the environmental sounds at one point from which they propagate invariantly to the ear) works best when the cross section of the collector opening 11 is limited. The bigger the collector opening, the smaller the frequency at which sound propagates from the collector opening to the ear invariantly (independently from the original source position). E.g. for a frequency of 1 kHz (wavelength 34 cm) a collector opening 11 of 5 cm diameter acts approximately as a collecting point. For a frequency of 6 kHz (wavelength 5.7 cm) a collector opening of 5 cm diameter doesn't act as a collecting point, but rather as a space that the sound wave trespasses differently depending from its direction of arrival. With such a collector opening dimension the compensation of higher frequencies will be impaired. For good performance at higher frequencies, the collector opening should have an area not bigger than 7 $cm^2$ (3 cm diameter for a circular opening). Optimally the collector opening 11 is circular with the microphone 30 placed in the middle and e.g. held by arms 31 in front of the opening 11.

Figure 3E:
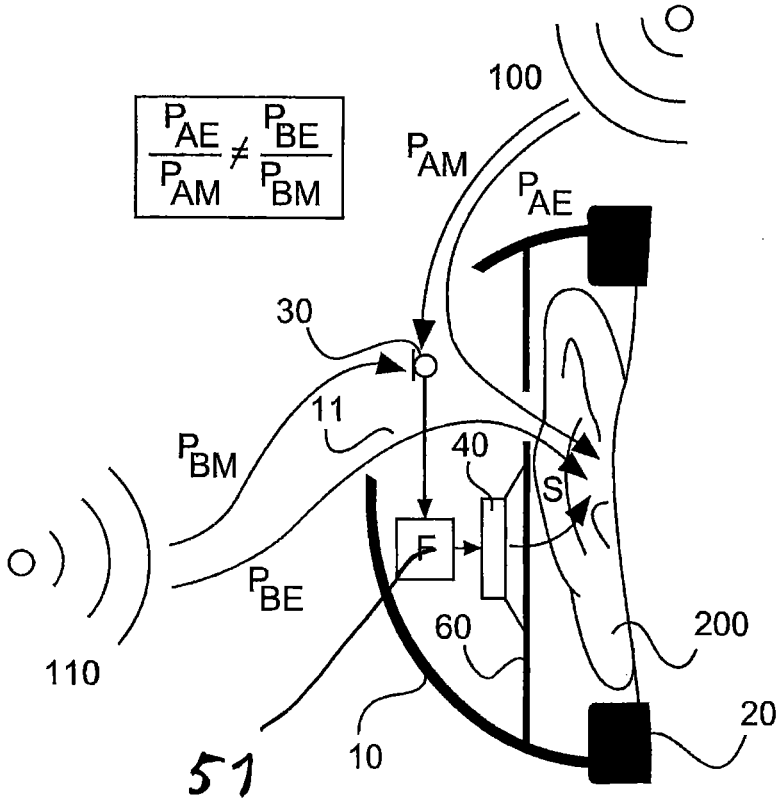
FIG. 3E shows a schematic representation of a headphone.

FIG. 3E shows a schematic representation of a headphone. Although the headphone has one dominant opening 11 as well as a feed-forward microphone 30 placed in the opening, the third condition of a limited cross section of the collector opening is not fulfilled. The opening is so big, that the intended effect of the invention doesn't hold, since sound coming from an arbitrary direction doesn't have a unique invariant quotient of transmission $P_E/P_M$. This opening doesn't match the collector function of the collector opening, as described in the invention.

Summarized, ambient sound penetrating to the ear via the headphone could only be cancelled out at a high degree by a non-adaptive feed-forward active noise cancellation system ANC when the conditions are fulfilled: a) the sound dominantly penetrates via one dominant collector opening, b) the feed-forward microphone is placed in or near the collector opening and c) the size of the collector opening is limited, typically to max. 7 $cm^2$.

For the characterisation of the dominance of the transmission path of the collector opening, the insertion loss of the headphone with the collector opening being opened and closed has to be measured. The difference of the insertion loss in both cases gives the amount of sound which penetrates to the ear through the collector opening. E.g. if the insertion loss at a certain frequency is increased by 10 dB when closing the collector opening, it means that a feed-forward ANC system according to the invention will provide an active noise cancellation of 10 dB, since all the sound penetrating via the collector opening can be cancelled out at a high degree. Differing from the invention, if there is at least one further dominant opening than the collector opening, closing the collector opening will not increase the insertion loss significantly (e.g. only 3 dB, since the sound still penetrate highly to the ear via the second dominant opening) and thus, there is only the few potential of 3 dB for feed-forward active cancellation performance, with a feed-forward microphone placed at the collector opening.

Figure 4A:
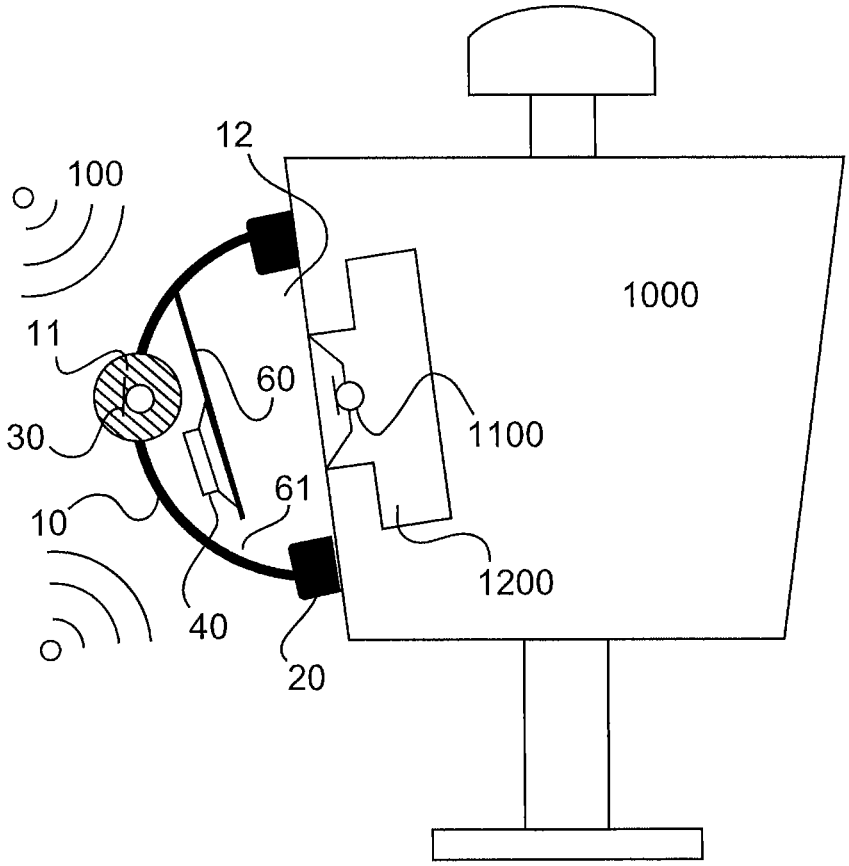
FIG. 4A shows a schematic representation of the measurement setup for identifying the arrangement according to the invention.

FIG. 4A shows a schematic representation of a measurement setup. As described above, the principle of the first aspect of the invention holds when a dominant transmission path from ambient sound source into the ear leads near the feed-forward microphone. Thus, for identifying if such a path exists, a putty ball of 2 cm radius is placed around the feed-forward microphone, as shown in FIG. 4A. Then a measurement of the insertion loss is accomplished according to ISO 4869-3. This measurement is then compared with an insertion loss measurement of the original headphone. If a significant change of the insertion loss is measured, this proves that a dominant transmission path according to the first aspect of the invention exists. A significant change is when there is an insertion loss change by at least 5 dB in at least one of the ⅓ octave bands from 200 Hz to 8 kHz. No significant change of the insertion loss will occur in the cases where there is no performance advantage for a feed-forward ANC system according to the invention: a) If there is no dominant opening near the feed-forward microphone (other openings may exist but are too distant from the feed-forward microphone), b) if there is an opening near the feed-forward microphone, but the opening is too small and does not transmit enough sound to inside the ear, c) if there is a significant opening near the microphone but there exist at least one further dominant opening such that closing the opening near the feed-forward microphone does not significantly effects the insertion loss and finally d) if there is an opening near the feed-forward microphone which is so big that the defined 2 cm radius putty ball could not close the whole area of the opening, which leads to the unchanged insertion loss. The radius of 2 cm is defined because this represents the distance from the feed-forward microphone to the collector opening at which a significant performance increase is achieved thanks to the positioning of the microphone according to the invention (where the necessary conditions $P_{AM}=P_{AO}$&$P_{BM}=P_{BO}$ still hold), A ball of putty is defined instead of a cover of putty, because a collector opening according to the invention may exist inside the headphone not visible from outside, and so, it could not be covered by a cover of putty placed on the headphone to test insertion loss change.

Figure 4B:
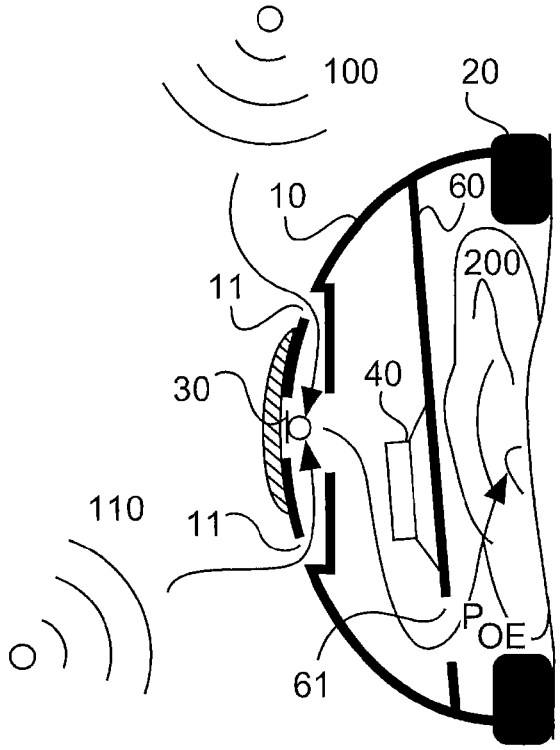
FIG. 4B shows a schematic representation of a measurement setup which is not appropriate for identifying the arrangement according to the invention.
Figure 4C:
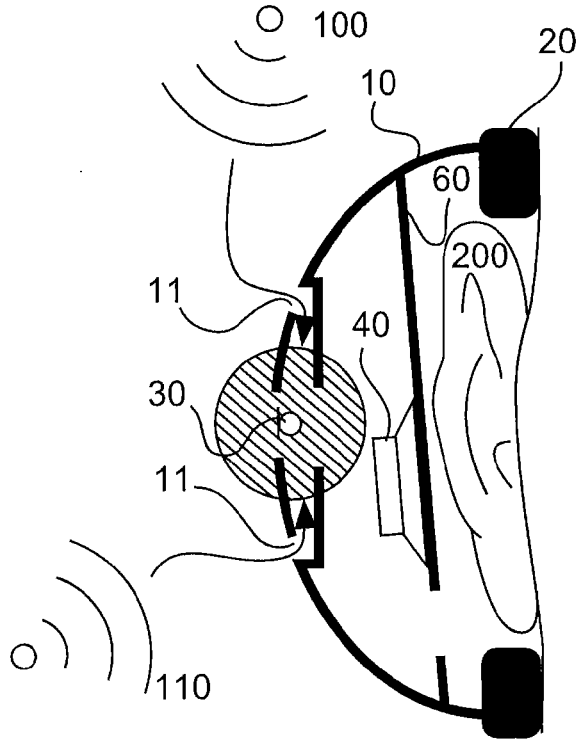
FIG. 4C shows a schematic representation of the measurement setup for identifying the arrangement according to the invention.

FIG. 4B shows such a headphone, where the dominant transmission path from outside to inside leads through a lateral gap between the ear cup of the headphone and a cover plate, and then enters to the headphone interior via a collector opening. The feed-forward microphone 30 is placed centric between the ear cup and the cover plate hearing to the collector opening, with the cover plate perforated in the centre just above the feed-forward microphone. A cover of putty used outside the ear cup would covers only the apparent opening of the cover plate, while the actual dominant transfer path near the feed-forward microphone was not closed for the insertion loss test. Using a ball of putty around the feed-forward microphone a shown in FIG. 4C enables to clearly test the existence of a dominant transfer path according to the invention, leading near the feed-forward microphone, regardless of the headphone shape.

Figure 5A:
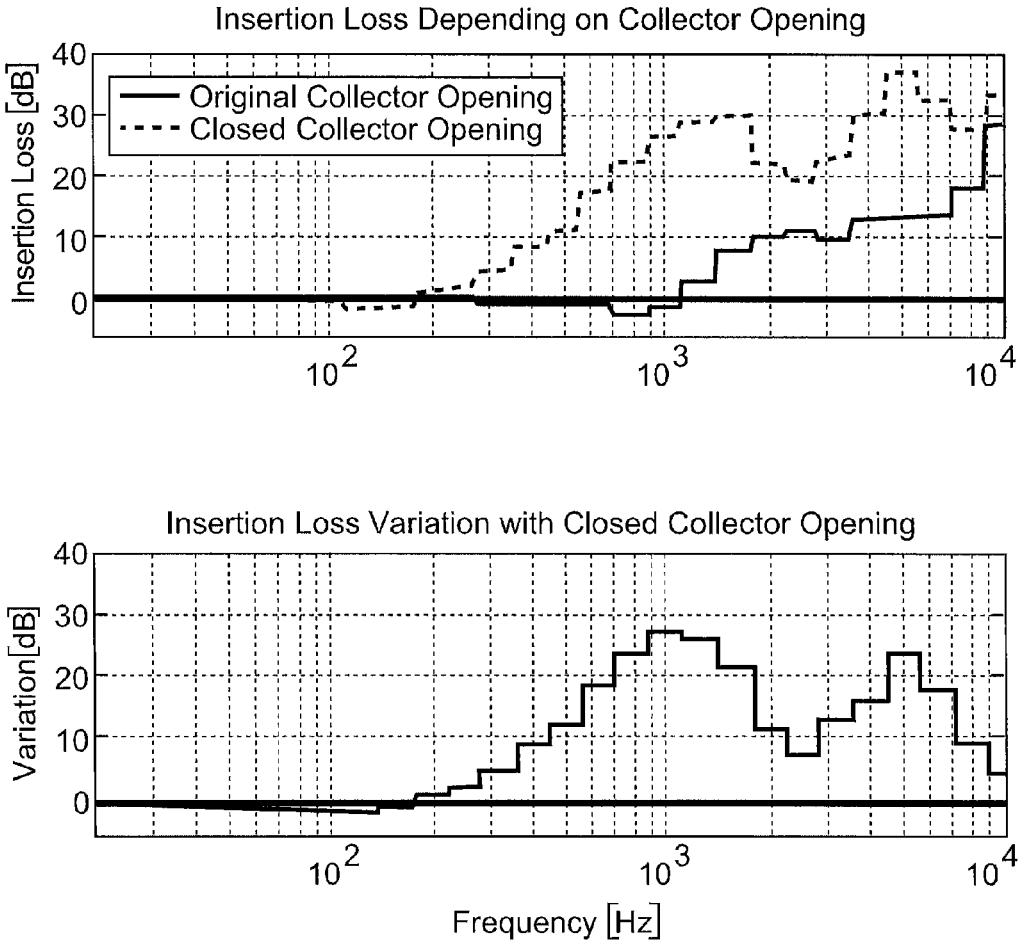
FIG. 5A shows a measurement result of the measurement setup according to FIG. 4A of a headphone according to the invention.

FIG. 5A shows an insertion loss measurement of a headphone according to the first or second embodiment of the invention with and without a putty ball around the feed-forward microphone. The insertion loss is given for ⅓ octave bands between 20 Hz and 10 kHz. It is a positive value when noise is damped. The headphone has a high collector opening, acting nearly open or semi-open. It has the advantages of open headphones but also a poor insertion loss. With a feed-forward microphone placed in the collector opening, the good insertion loss of the headphone having its collector opening closed can be restored actively.

Figure 5B:
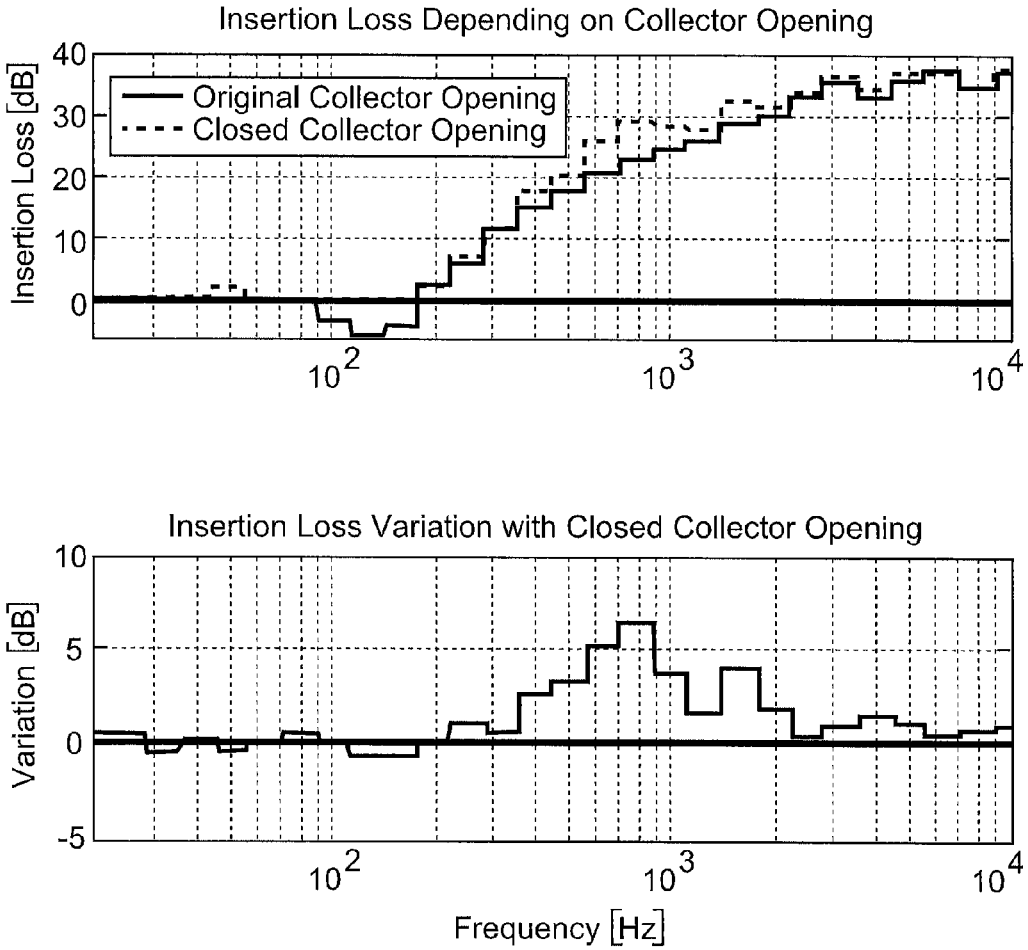
FIG. 5B shows a measurement result of the measurement setup according to FIG. 4A of a headphone according to the invention.

FIG. 5B shows an insertion loss measurement of a second headphone according to the third embodiment of the invention with and without a putty ball around the feed-forward microphone. The headphone is a closed headphone with a venting designed for acoustical tuning. The venting decreases the insertion loss moderately. Using the acoustical arrangement according to the invention, with the venting being the collector opening where a feed-forward microphone is placed, the insertion loss of the non-vented headphone can be restored actively.

The variation of the insertion loss directly gives the potential for active noise cancellation enhancement using a feed-forward ANC system according to the invention. A significant performance effect is achieved when a significant change of the insertion loss according to the measurement described above occurs. A significant change of the insertion loss was defined above as being a change by at least 5 dB in at least one ⅓ octave band from 200 Hz to 8 kHz, since this corresponds to a significant enhancement of the active noise cancellation.

It should be noted that the system according to the invention can be extended to a multiple channel feed-forward ANC system with multiple dominant collector openings, each of them adjacent to a feed-forward microphone. Each feed-forward microphone feeds an own ANC filter and its filter response which is a portion from the total antinoise will highly damp the portion of ambient sound which penetrates to the ear via the dominant opening where the microphone is placed. For the testing of the existence of a dominant transmission path near a microphone, all the feed-forward microphones are covered by a 2 cm ball of putty and each microphone is tested alone by removing the putty from it and comparing the insertion loss with and without putty at this microphone. When a significant change of the insertion loss is measured at a microphone, this means that a performance advantage is achieved according to the invention, since the related ANC channel will highly damp a significant portion of the sound penetrating to the ear. A second aspect of the invention deals with the causality condition of the transfer function of the optimal filter $F=-P_{OE}/S$.

Figure 6:
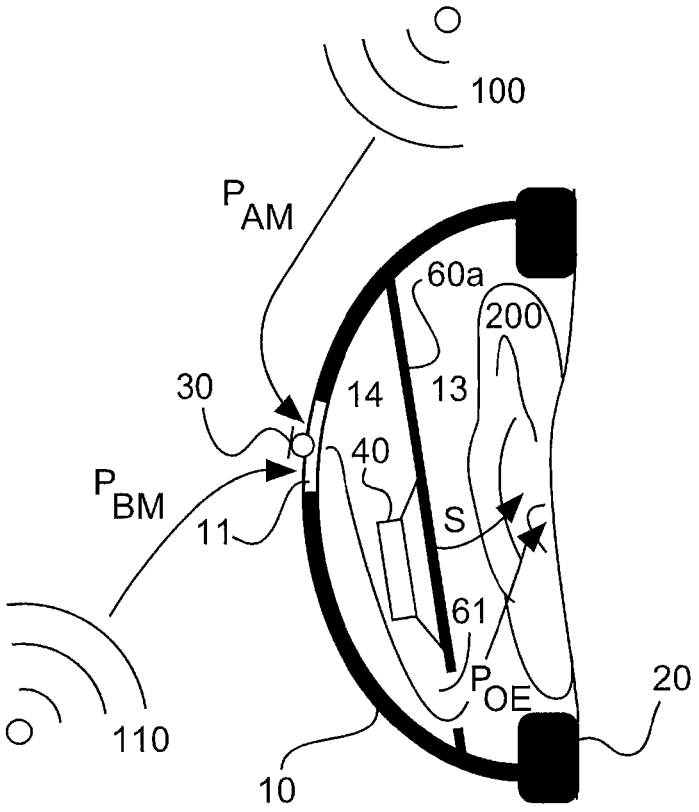
FIG. 6 shows a schematic representation of a headphone according to a fourth embodiment.
Figure 7:
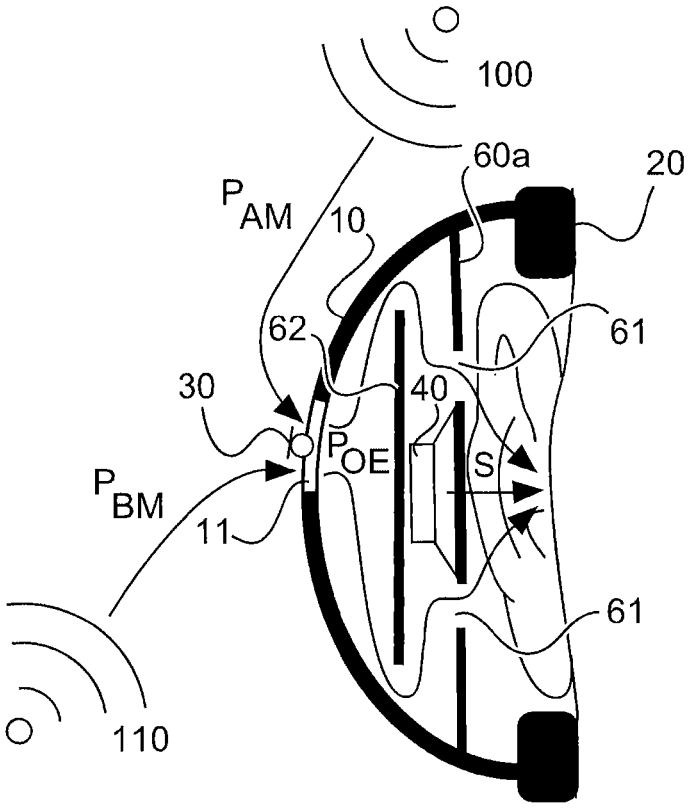
FIG. 7 shows a schematic representation of a headphone according to a fifth embodiment.

FIG. 6 and FIG. 7 each show a schematic representation of a headphone or headset according to a fourth and fifth embodiment implementing the second aspect of the invention. The headphone according to FIG. 6 comprises a housing 10, an earpad 20, an opening 11 in the housing 10, a feed-forward microphone 30 arranged in, adjacent or near the opening 11, an electro-acoustic transducer 40 and an active-noise-compensation unit (not shown). In the housing 10, a time delay unit 60 is shown which comprises a wall 60*a* and an opening 61. The time delay unit 60 is arranged between the front volume 13 and the rear volume 14 inside the housing 10. The opening 61 of the time delay unit 60 is positioned relatively to the opening 11 such that any sound entering via the opening 11 is delayed before it reaches the ear 200 of the user. This delay is intentional to allow the active noise compensation algorithm to determine the required compensation signal.

The headphone according to FIG. 7 substantially corresponds to the headphone according to FIG. 6, wherein the sound delay unit 60 comprises a first and second portion, wherein the first portion comprises a wall 60*a* and at least one opening 61. In the second portion which is arranged in the rear volume, a wall 62 is present which also comprises at least one opening 63. The sound entering via the opening 11 must travel through the openings 63 of the second portion and then via the openings 61 in the first portion before it reaches the ear of the user. According to the second aspect of the invention a delay is added to the transmission path $P_{OE}$ which compensates for the delay of the Path S and the optimal feed-forward filter $F=-P_{OE}/S$ becomes causal. The sound delay unit can introduce a time delay of for example 80 μs.

The sound-delaying unit 60 can be implemented as a labyrinth to elongate the path that the sound signal must travel from the opening 11 to the ear.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A circumaural or supraaural headphone, comprising:

a housing comprising:

an open end; and at least one defined dominant acoustic opening;

an acoustically sealing earpad arranged at the open end of the housing;

at least one microphone configured to detect noise, and arranged adjacent to, near, or in the vicinity of the dominant acoustical opening;

an active-noise-compensation unit configured to perform an active noise compensation based on an output of the at least one microphone, and configured to generate a compensation signal; and an electro-acoustic transducer arranged inside the housing, and configured to reproduce the compensation signal;

wherein the dominant acoustic opening is arranged within a radius of 2 cm around a midpoint of the at least one microphone; and wherein the at least one microphone is arranged such that a sound transmission time from the at least one microphone to an entrance of an ear channel of a user wearing the headphone is greater than a sound transmission time from the electro-acoustic transducer to the entrance of the ear channel.

2. The circumaural or supraaural headphone according to claim 1;

wherein a sound-delaying unit is arranged between the dominant acoustical opening and the open end of the housing, and is configured to delay the sound entering the acoustical opening.

3. The circumaural or supraaural headphone according to claim 1;

wherein the microphone is a feed-forward microphone; and wherein the active-noise-compensation unit is configured to perform the active noise compensation based on a feed-forward algorithm.

4. The circumaural or supraaural headphone according to claim 1;

wherein the dominant acoustic opening has an area which is not larger than 7 $cm^2$.

5. The circumaural or supraaural headphone according to claim 1;

wherein, when closed, the dominant acoustic opening has a change of an insertion loss, as measured according to ISO 4869-3, of at least 5 dB in at least one of the ⅓ octave bands from 200 Hz to 8 kHz.

6. A circumaural or supraaural headset, comprising:

a housing comprising:

an open end; and at least one defined acoustic opening;

an acoustically sealing earpad arranged at the open end of the housing;

at least one microphone configured to detect noise, and arranged adjacent to, near or in the vicinity of the acoustical opening;

an active-noise-compensation unit configured to perform an active noise compensation based on the output of the at least one microphone, and configured to generate a compensation signal; and an electro-acoustic transducer arranged inside the housing, and configured to reproduce the compensation signal;

wherein the acoustic opening is arranged within a radius of 2 cm around a midpoint of the at least one microphone; and wherein the at least one microphone is arranged such that a sound transmission time from the at least one microphone to an entrance of an ear channel of a user wearing the headphone is greater than a sound transmission time from the electro-acoustic transducer to the entrance of the ear channel.

* * * * *